United States Patent [19]

Achstaetter

[11] Patent Number: 4,775,829

[45] Date of Patent: Oct. 4, 1988

[54] ON-CHIP VOLTAGE STABILIZING CIRCUIT

[75] Inventor: Gerhard Achstaetter, Gundelfingen, Fed. Rep. of Germany

[73] Assignee: Deutsche ITT Industries GmbH, Freiburg, Fed. Rep. of Germany

[21] Appl. No.: 125,900

[22] Filed: Nov. 27, 1987

[30] Foreign Application Priority Data

Dec. 16, 1986 [EP] European Pat. Off. ..... 86 11 7494.4

[51] Int. Cl.[4] ..... G05F 3/22; G05F 5/08

[52] U.S. Cl. ..... 323/313; 323/303; 323/315; 330/149; 330/297

[58] Field of Search ..... 323/303, 313, 314, 315; 330/149, 297

[56] References Cited

U.S. PATENT DOCUMENTS

| | | | |
|---|---|---|---|
| 2,995,697 | 8/1961 | Grenier | 323/303 |
| 4,176,308 | 11/1979 | Dobkin et al. | 323/314 |
| 4,349,778 | 9/1982 | Davis | 323/314 |
| 4,565,959 | 1/1986 | Nagano | 323/315 |

FOREIGN PATENT DOCUMENTS

| | | | |
|---|---|---|---|
| 0125646 | 11/1984 | European Pat. Off. . | |
| 215190 | 10/1984 | German Democratic Rep. | 323/313 |
| 2427233 | 5/1975 | Fed. Rep. of Germany . | |
| 112009 | 8/1980 | Japan | 330/149 |

OTHER PUBLICATIONS

King, "Power Supply Sequencing Circuit," IBM Tech. Discl. Bul., vol. 19, No. 5, p. 1179, Oct. 1976.

*Primary Examiner*—William H. Beha, Jr.
*Attorney, Agent, or Firm*—T. L. Peterson

[57] ABSTRACT

In order to substantially suppress the noise of an integrated constant-voltage source, an integrated circuit includes an RC low-pass filter having its capacitor connected between an external chip terminal and an external ground, while the remainder of the circuit is disposed on the integrated circuit chip. The resistor of the RC low-pass filter is connected to the constant voltage of a constant-voltage source, and the output of the RC low-pass filter is coupled to the base of a transistor connected ahead of emitter-follower transistors as in a Darlington circuit. The supply voltages are obtained from the emitters of the emitter-follower transistors. A constant-current source driven by the output of the RC low-pass filter via a second resistor serves as a sink for a constant current.

8 Claims, 1 Drawing Sheet

ON-CHIP VOLTAGE STABILIZING CIRCUIT

BACKGROUND OF THE INVENTION

1. Field of the Invention

The present invention relates to integrated circuits wherein internally needed supply voltages are commonly derived by means of a constant-voltage source forming part of the integrated circuit.

2. Description of the Prior Art

A frequently used constant-voltage source of this kind is the so-called band-gap reference circuit. It was discovered, however, that in specific applications, such as in analog-to-digital converters for high-quality audio applications, the noise of conventional constant-voltage sources reaches the audio channel and, thus, becomes audible.

SUMMARY OF THE INVENTION

Accordingly, the problem to be solved by the invention is to substantially eliminate the noise of conventional constant-voltage sources by circuit means so that audio channels will no longer be audibly disturbed. Furthermore, the invention makes it possible to derive from the voltage of the constant-voltage source several supply voltages and constant currents which serve to operate the individual chip subcircuits. The solution to these problems is set forth in the claims.

BRIEF DESCRIPTION OF THE DRAWING

The invention will now be explained in greater detail with reference to the accompanying drawings, in which.

DETAILED DESCRIPTION

Figure 1:
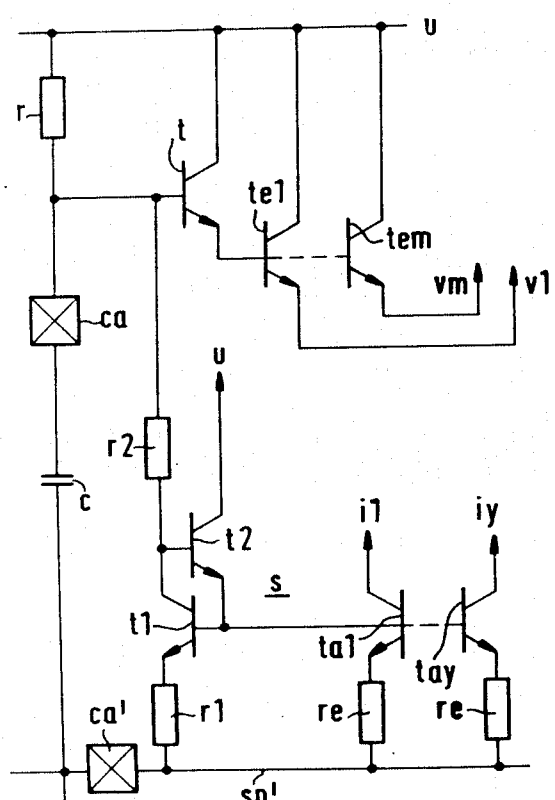
FIG. 1 is a circuit diagram of an embodiment of the invention.

The embodiment of the invention shown in the circuit diagram of FIG. 1 relates to an implementation of the invention using bipolar transistors of one and the same conductivity type, namely NPN transistors. However, it is within the ability of those skilled in the art to modify the invention so that the NPN transistors can be replaced by PNP transistors. It is also possible, however, to use MOS transistors instead of bipolar transistors, namely either n-channel or p-channel transistors.

The above-mentioned constant-voltage source is not shown in the figures of the drawing; the figures only show the line to which the constant voltage u of the constantvoltage source is applied. Connected between this line and the base of a transistor t is a resistor r, which forms part of an RC low-pass filter. The transistor t is connected ahead of emitter-follower transistors te1 . . . tem in a Darlington-like configuration. The bases of the transistors te1 . . . tem are connected to the emitter of the transistor t. The collectors of the emitter-follower transistors te1 . . . tem and the collector of the transistor t are connected to the constant voltage u. The emitters of the emitter-follower transistors te1...tem each provide one of the supply voltages v1 . . . vm respectively, which are isolated from each other.

The base of the transistor t is also connected via an external chip terminal ca to a capacitor c, which forms part of the RC low-pass filter and has its other end connected to external ground sn. The latter is connected via the additional external chip terminal ca' to an internal ground sn'.

FIG. 1 further includes a current-mirror circuit s, with which the constant currents i1 . . . iy are generated. The current-mirror circuit includes a first transistor t1, whose emitter is connected to internal ground sn' through a first resistor r1, and whose collector is connected to the output of the RC low-pass filter and, thus, to the base of the transistor t through a second resistor r2.

A second transistor t2 of the current-mirror circuit s has its base and emitter connected to the collector and the base, respectively, of the first transistor t1, while its collector is connected to a point having a suitable voltage. This may for example, be the constant voltage u (as shown) or the emitter of the transistor t (see FIG. 2, discussed below). The base of the transistor t1 is also connected to the bases of the output transistors ta1 . . . tay, whose emitters are connected directly or through respective emitter resistors re to the internal ground sn'.

Figure 2:
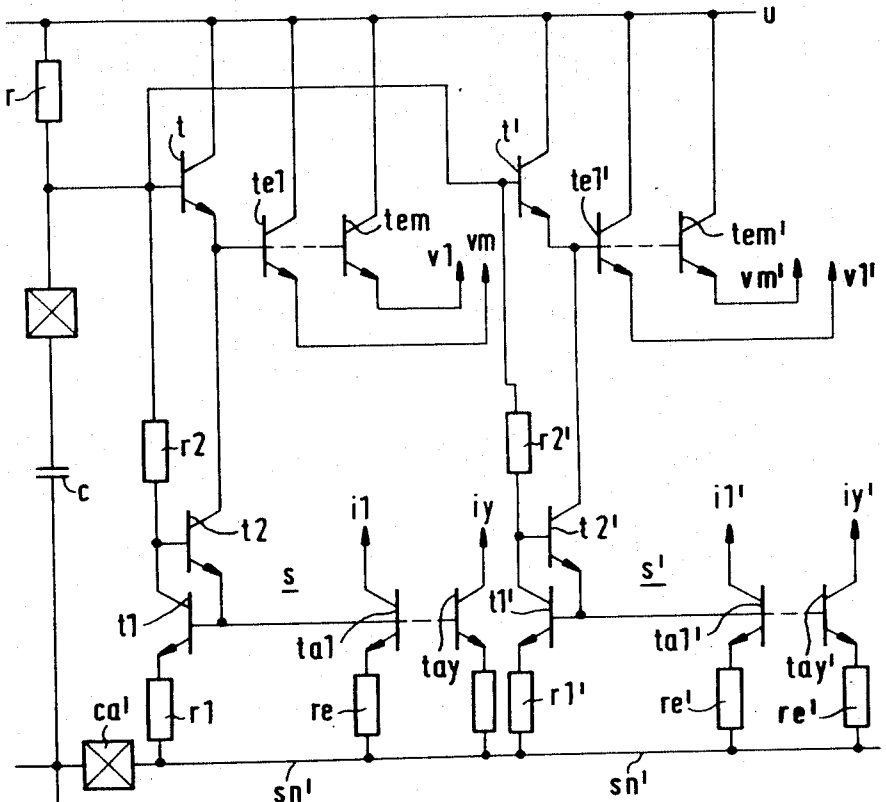
FIG. 2 shows a development and an advantageous aspect of the invention.

In the embodiment shown in FIG. 2, the subcircuit including the transistors t, te1 . . . tem and the current-mirror circuit are present again in duplicate form. The additional subcircuit includes the corresponding transistors t', te1'. . . tem', with the base of the transistor t' connected to the base of the transistor t. By this expansion, additional supply voltages v1'. . . vm' are produced which are better isolated from the supply voltages v1 . . . vm than the latter from each other. Such an arrangement is particularly advantageous if the integrated circuit contains two audio channels, e.g., stereo channels, which are to influence each other as little as possible.

The additional current-mirror circuit s' consists of the transistors t1', t2', ta1 . . . tay' and the resistors r1', r2', re'. If required, further subcircuits and currentmirror circuits may be provided. The number of additional subcircuits can be chosen freely. FIG. 2, with its two subcircuits and two current-mirror circuits, illustrates only one of the possible embodiments.

Also shown in FIG. 2 is the above-mentioned advantageous feature according to which the collector of the transistor t2 of the current-mirror circuit s is connected to the emitter of the transistor t rather than to the constant-voltage u, as was illustrated in FIG. 1.

Besides the above-mentioned variants in the implementation of the invention using different transistor types, it is possible to implement one part of the circuit with NPN transistors and the other part with PNP transistors. N-channel and p-channel field-effect transistors can also be used. That will be the case particularly if the constant-current source is not to be referred to ground, i.e., to act as a current sink as in the embodiments of FIGS. 1 and 2, but if constant currents are to be derived from the constant voltage u which flow into further subcircuits.

The cutoff frequency of the RC low-pass filter is preferably below 50 Hz, which means that the capacitance of the capacitor c will generally be in the range between 2 and 20 microfarads.

What is claimed is:

1. An on-chip voltage-stabilizing circuit, comprising:

a constant-voltage source;

a first voltage supply input transistor having an input terminal, an output terminal and a control terminal, the input terminal of said first voltage supply input transistor connected to said constant-voltage source;

a first voltage supply output transistor and a second voltage supply output transistor each having an input terminal, an output terminal and a control terminal, the input terminals of said first and second voltage supply output transistors connected to said constant-voltage source, and the control terminals of said first and second voltage supply output transistors connected to the output terminal of said first voltage supply input transistor in a Darlington-like configuration;

a first supply voltage output and a second supply voltage output connected to the output terminals of said first and second voltage supply output transistors, respectively, which derive said supply voltages from the constant voltage of said constant-voltage source; and an RC low pass filter including:

a first resistor interposed between the output of the constant-voltage source and the control terminal of said first voltage supply input transistor; and a first capacitor connected between a ground reference and the control terminal of said first voltage supply input transistor, the common connection of said first resistor, said first capacitor, and said control terminal of said first voltage supply input transistor being the output of said RC low-pass filter.

2. The circuit as defined in claim 1, wherein the RC low-pass filter has an upper cutoff frequency less than 50 Hz.

3. The circuit as defined in claim 1, additionally comprising:

a second voltage supply input transistor having an input terminal, an output terminal and a control terminal, the input terminal of said second voltage supply input transistor connected to said constant-voltage source, the control terminal of said second voltage supply input transistor connected to the output of said RC low-pass filter;

a third voltage supply output transistor and a fourth voltage supply output transistor each having an input terminal, an output terminal and a control terminal, the input terminals of said third and fourth voltage supply output transistors connected to said constant-voltage source, and the control terminals of said third and fourth voltage supply output transistors connected to the output terminal of said second voltage supply input transistor in a Darlington-like configuration; and a third supply voltage output and a fourth supply voltage output connected to the output terminals of said third and fourth voltage supply output transistors, respectively, which derive said supply voltages from the constant voltage of said constant-voltage source.

4. The circuit as defined in claim 1, including a current-mirror circuit for providing first and second constant current outputs, said current-mirror circuit comprising:

a first current-mirror input transistor having an input terminal, an output terminal and a control terminal, the output terminal of said first current-mirror input transistor connected to an internal ground reference through a first current-mirror resistor, the input terminal of said first current-mirror input transistor connected to the output of the RC low-pass filter through a second current-mirror resistor;

a second current-mirror input transistor having an input terminal, an output terminal and a control terminal, the control and output terminals of said second current-mirror input transistor connected to the input and control terminals, respectively, of said first current-mirror input transistor, and the input terminal of said second current-mirror input transistor connected to a selected voltage source; and a first and a second current-mirror output transistor, each having an input terminal, an output terminal and a control terminal, the control terminal of said first and second current-mirror output transistors connected to the control terminal of said first current-mirror input transistor and the output terminals of said first and second current-mirror output transistors electrically connected to said internal ground reference, the input terminals of said first and second current-mirror output transistors providing said first and second constant current outputs.

5. The circuit as defined in claim 4, wherein said input terminal of said second current-mirror input transistor is connected to said constant voltage source.

6. The circuit as defined in claim 4, wherein said input terminal of said current-mirror input transistor is connected to said output terminal of said first voltage supply transistor.

7. The circuit as defined in claim 4, wherein a first emitter resistor is interposed between the output terminal of said first current-mirror output transistor and said internal ground reference and a second emitter resistor is interposed between the output terminal of said second current-mirror output transistor and said internal ground reference.

8. The circuit as defined in claim 1, wherein said first supply voltage input transistor and said first and second supply voltage output transistors are bipolar transistors and wherein the input, output and control terminals of said transistors are of the collector, emitter and base terminals, respectively, of said transistors.

* * * * *